United States Patent [19]

Steck

[11] Patent Number: 4,526,066

[45] Date of Patent: Jul. 2, 1985

[54] TORSION SPRING ADJUSTING TOOL AND METHOD

[75] Inventor: George L. Steck, Dayton, Ohio

[73] Assignee: Steck Manufacturing Co., Inc., Dayton, Ohio

[21] Appl. No.: 484,868

[22] Filed: Apr. 14, 1983

[51] Int. Cl.[3] ..... B25B 13/48

[52] U.S. Cl. ..... 81/486; 81/180.1; 76/101 D

[58] Field of Search ..... 81/3 R, 121, 119, 90 R, 81/90 C, 90 F, DIG. 8, 180 R; 72/388, 409, 458; 29/240, 230, 267

[56] References Cited

U.S. PATENT DOCUMENTS

| | | | |
|---|---|---|---|
| 1,131,035 | 3/1915 | Brown | 81/119 |
| 1,736,585 | 11/1929 | Fehlhaber | 40/117 |
| 2,723,578 | 11/1955 | Konola | 72/458 |
| 2,739,500 | 3/1956 | Kordish | 81/90 C |
| 3,578,046 | 5/1971 | Curran | 81/90 R |
| 3,651,719 | 3/1972 | Wessel | 81/3 R |
| 3,737,970 | 6/1973 | Tracy | 72/458 |
| 3,888,101 | 6/1975 | Crees | 72/458 |
| 3,891,185 | 6/1975 | Lett | 81/3 R |
| 4,142,283 | 3/1979 | Walker et al. | 29/227 |
| 4,220,036 | 9/1980 | Scheetz | 72/458 |
| 4,253,350 | 3/1981 | DeTarr | 81/3 R |
| 4,304,117 | 12/1981 | Rawson | 72/457 |

*Primary Examiner*—Roscoe V. Parker
*Attorney, Agent, or Firm*—Dybvig & Dybvig

[57] ABSTRACT

A torsion spring adjusting tool comprises a hexagonal shank to one end of which are welded confronting plate portions which project longitudinally outwardly from said one end, the arrangement being such that wrench means engaging said hexagonal shaped shank can apply a twisting source to a portion of torsion spring extending between said confronting plates. The confronting plates have their confronting surfaces configured to provide obliquely exposed cylindrical passageways inclined at a substantial angle one to the other so that the tool is suitable either to right-hand or left-hand operation.

7 Claims, 2 Drawing Figures

TORSION SPRING ADJUSTING TOOL AND METHOD

SUMMARY OF THE INVENTION

Trunk decks for modern automobiles have associated torsion spring devices which bias the trunk deck open when unlocked. As the automobile ages or is damaged, torsion spring adjustment is sometimes desired and, to this end, the present invention is concerned with the construction of a torsion spring adjusting tool. The torsion spring adjusting tool comprises a shank portion which is made flat along one surface for wrench engagement so that the adjusting tool may be rotated about the axis of the shank portion. Affixed to one end of the shank portion is a clevis portion for drivingly interfitting the torsion device, thus to allow a rotary force delivered to the shank portion by a wrench to be transmitted through the clevis portion for purposes of adjusting the torsion spring tension.

DESCRIPTION OF THE PREFERRED EMBODIMENT

Modern American made automobiles are typically equipped with a trunk deck which is adapted to close a trunk opening, the trunk deck being equipped with a key-operated latch, not shown, which normally is operated to hold the trunk deck in a position closing the trunk opening. With a key, the latch is released and spring means, normally concealed within the trunk opening, bias the trunk deck upwardly so that the operator of the key can then pull the key upwardly or grab an exposed edge of the trunk deck to manually lift the deck with continuing aid from the biasing springs to an essentially open position. This position is held by the biasing springs until the operator exerts a force on the trunk deck opposing the bias of the springs so as to close the trunk deck whereupon the aforementioned latch will return to a position holding the trunk deck closed.

Figure 1:
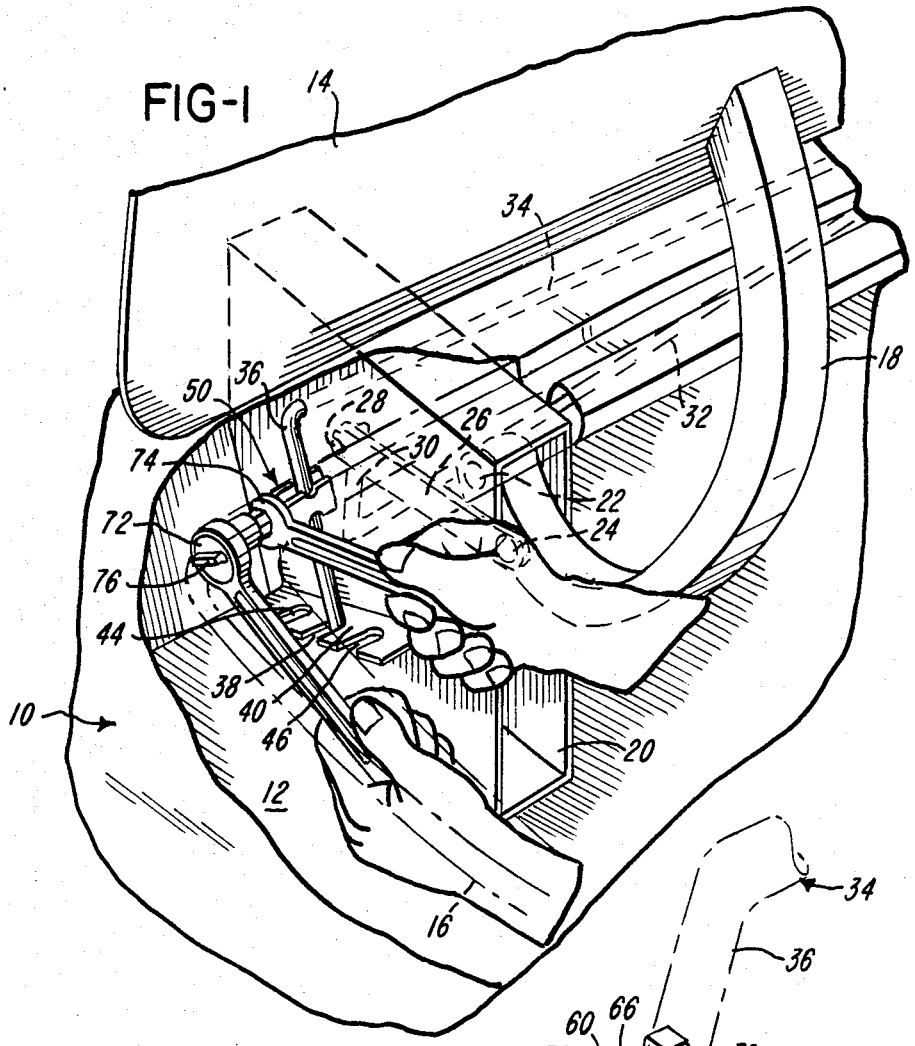
FIG. 1 is a fragmentary isometric illustration with a portion shown in section, another portion shown in phantom and still other portions broken away to illustrate the trunk opening and trunk deck of a conventional automobile, with there being an illustration of an operator's hands manipulating tools for adjusting the torsion spring adjusting tool of the present invention.

FIG. 1 is a fragmentary illustration of the rear end of an automobile after its trunk deck has been opened fully to expose the trunk opening. Thus, in FIG. 1, the reference number 10 identifies generally the rear end of the automobile and the reference number 12 identifies generally the interior of the now exposed trunk compartment. The reference number 14 identifies the trunk deck which is illustrated only fragmentarily. The reference number 16 identifies a gasket, shown in phantom detail, against which the deck 14 seals when the trunk is closed.

Welded or otherwise attached to the interior of the trunk deck 14 is one end of a curved support or strut 18 whose opposite end enters a parallelepiped shield or housing 20, which enables the strut 18 to move without any appreciable risk of damage to items such as luggage that may reside in the trunk compartment.

It can be noted that the parallelepiped housing 20 rests on the floor of the trunk opening and projects upwardly for approximately the interior height of the trunk compartment and, where the illustration of this housing is broken, extends within the trunk opening under and behind the trunk deck 14.

Those skilled in the art will appreciate that only approximately the left half of the trunk deck 14 and the underlying trunk compartment appear in FIG. 1, there being a similar right side strut disposed to the right side of the vehicle and not appearing in FIG. 1 because of the manner in which the vehicle was broken away to facilitate illustration of the left side structure of the trunk compartment.

The illustrated strut 18 is pivoted on a pin 22 welded or otherwise supported between the interior vertically extending side walls of the housing 20.

Spaced rearwardly of the pin 22 is a pin 24 on which pivots a forwardly extending link 26. Due to the rearward spacing of the pin 24, the link 26 is driven forwardly as the trunk deck 14 is lowered to close the trunk opening.

The link 26 is pivotally secured by a pin 28 to a foot 30 projecting at roughly a right angle from an elongated torsion spring 32 anchored at the right side of the trunk opening. Thus, when the trunk deck 14 is closed, the pivotal movement of the strut 18 about the pin 22 will cause the eccentrically located pin 24 to drive forwardly the link 26. This forward movement of the link 26 forces the foot 30 inwardly of the trunk opening thus imparting a twist to the torsion spring 32 with the result that energy is accumulated in the torsion spring 32 which can assist a subsequent opening of the trunk deck 14. More particularly, the energy stored in the spring 32 will supply a bias to the link 26 acting against the eccentrically located pin 24 which will tend to raise the deck 14 by reason of a pivotal movement about the pin 22.

Symmetrically oppositely arranged with respect to the torsion spring 32 having its foot 30 is a torsion spring 34 having a foot comparable to the foot 30 but not appearing in FIG. 1 because that foot is on the right side of the trunk opening and thus broken away from the FIG. 1 illustration. The torsion spring 34 terminates at its left end with an arm 36 caged in a slot 38 located in a right angular bracket 40 one side of which is welded or otherwise affixed to the outside left side wall of the housing 20. The opposite side of the bracket 40 has further slots 44 and 46 flanking the slot 38 presently caging the arm 36 and spaced from the slot 38 by intermediate portions 42 remaining as part of the bracket 40 when the slots 38, 44 and 46 are formed.

What has thus far been described in reference to FIG. 1 is a conventional trunk closure mechanism. At the time of original manufacture, it is contemplated that the arm 36 for the torsion spring 34 as well as the corresponding arm, not shown, for the torsion spring 32 will be caged in centrally located slots so that either a torque increasing or a torque decreasing adjustment may be made as an automobile is assembled.

In the particular automobile assembly being described in reference to FIG. 1, the slots 38, 44 and 46 slope forwardly of the vehicle from their closed ends to their open ends. This means it is relatively easy to increase the trunk deck bias by shifting the arm 36 from the slot 38 to the slot 44, or to make a corresponding adjustment of the torsion spring 32 but, in contrast, it is noticeably more difficult to shift the arm 36 from the slot 38 to the slot 46. In any event, the original manufacturer does not contemplate any adjustment of the tension being applied to the trunk deck 14 after being preset on first manufacture.

Instances occur, however, usually as a result of accident or abuse when the torsion associated with the torsion springs 32 and 34 is inadequate to effectively assist the operator seeking to fully open the trunk deck. The present invention has been devised for use in circumstances where a post-manufacture torsion adjustment has been found necessary or desirable.

Figure 2:
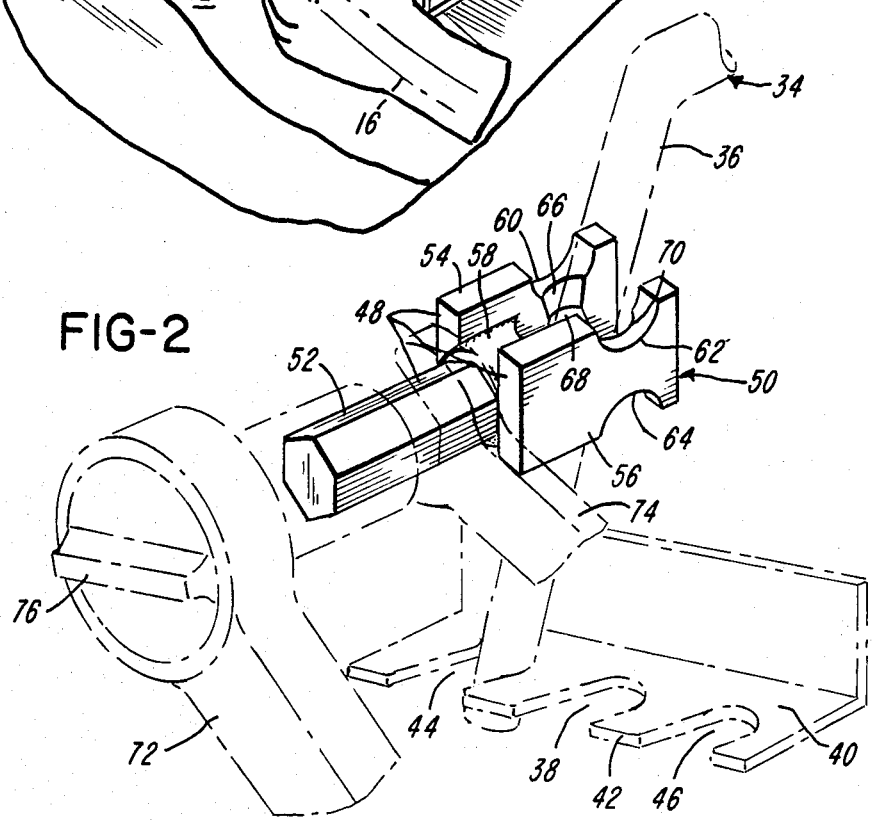
FIG. 2 is an isometric illustration showing in solid lines the torsion spring adjusting tool of the present invention, showing in phantom lines fragmentary portions of a trunk opening of the type in which the tool is designed to operate and showing other tools used to manipulate the torsion spring adjusting tool.

As best seen in FIG. 2, the adjustment tool 50 comprises a shank 52 whose side surfaces have been made flat in such fashion that the shank has a hexagonal cross-section. One end of the shank 52 is welded between plates 54 and 56 which straddle the welded end of the shank 52 and cooperate therewith to form a clevis 48. The plates 54 and 56 are initially rectangular plates with their longest sides extending lengthwise in a direction parallel to the longitudinal axis of the shank 52. The reference number 58 identifies an accumulation of metal from the clevis shank 52 which melted and then hardened as the clevis plates 54 and 56 were fused to the clevis shank 52.

The clevis plate 54 has an arcuate cutout 60 located along the upper edge of its longest side as it appears in FIG. 2. The clevis plate 54 also has a symmetrically opposite cutout along the lower edge of its longest side which does not appear in FIG. 2. The clevis plate 56 has symmetrically opposite upper and lower cutouts 62 and 64 along the edges of its longest side analogous to those described in reference to the clevis plate 54.

It can be noted that the inside face of the clevis plate 54 has a curved rectangular surface 66 lying under the arcuate cutout 60 and making an edge junction with such cutout. This curved rectangular surface 66 was shaped by milling the interior face of the clevis plate 54 with a tool rotated about an axis inclined approximately 30° to the original face of the clevis plate 54 in which the arcuate surface 66 appears. Such milling was continued downwardly to produce a similar curved rectangular surface located on the inside face of the clevis plate 56 and making an edge junction with the arcuate cutout 64 at the lower edge of the clevis plate 56. Those skilled in the art will recognize that such milling has produced a first cylindrical passageway extending obliquely with respect to the original faces of the clevis plates 54 and 56. The arcuate surface 66 underlying the cutout 60 and the corresponding arcuate surface in the clevis plate 56 overlying the cutout 64 are thus coaxially aligned.

Lying under the arcuate surface 66 in the clevis plate 54 is another arcuate surface 68 making an edge junction with the arcuate surface 66. This underlying arcuate surface 68 has been milled with a cutting tool rotated about an axis which slopes about 30° relative to the original face of the clevis plate 54, such milling creating a second cylindrical passageway inclined approximately 60° from the first passageway above described and thus creating a symmetrically opposite arcuately curved surface having a junction 70 with the arcuate cutout 62 in the clevis plate 56.

The arcuate surface 68 in the clevis plate 54 is coaxially aligned with its symmetrically opposite arcuate surface making the junction 70 with the cutout 62 in the clevis plate 56 and, as shown in FIG. 2, these surfaces provide seats against which bears the arm 36 illustrated by broken lines in FIG. 2.

It can be noted that FIG. 2 illustrates the arm 36 of the torsion spring 34 seated in the slot 44 of the bracket 40, whereas, the same arm was seated in the slot 38 in FIG. 1. What has happened is that by means to be described a workman has employed the tool 50 to shift the arm 36 from the slot 38 to the slot 44, FIG. 2 illustrating the alignment between the tool 50 and the arm 36 as if the worker is now trying to return the arm 36 back to the slot 38. It can be noted that the torque developed through rotation of the clevis shank 52 seeks to wrap the arm 36 into the cutouts in the longer edges of the plates 54 and 56, but of course, the arm 36 is too stiff to be wrapped about the clevis plates 54 and 56. Instead the torque merely acts to move the arm 36 in such a direction that the torsion spring 34 is twisted about its own longitudinal axis.

Adjustment of the arm 36 with aid of the tool 50 is accomplished by means of wrench devices 72 and 74. The wrench device 72 is a common socket wrench with a conventional ratchet mechanism, not shown, but preset so that when the socket is engaged to the hexagonal shank 52 and the wrench handle lifted upwardly as it appears in FIG. 2, the wrench will draw the tool 50 to the position appearing in FIG. 2. Should the handle of the tool 72 then be lowered, the tool 50 will pivot until the surface 66 bears against the arm 36 whereupon the ratchet mechanism will slip. Since the clevis plates 54 and 56 were similarly but oppositely milled, the two confronting milled surfaces such as the surface 66 define a triangular opening between the clevis plates 54 and 56 spanning approximately a 60° arc. Thus, there is approximately 60° of free space diminished by the diameter of the arm 36 along which the tool 50 can be pivoted by the tool 72 without encountering the resistance of the surface 66 at one end of its movement and the confronting curved surface of the clevis plate 56.

When the wrench 72 is lifted upwardly as it appears in FIG. 2, the curved surface on the clevis plate 56 bears against the arm 36 and the upward movement of the tool 72 applies a twisting force to the spring 34 by rotating the shank 52 so as to swing the clevis plate 54 under the clevis plate 56. It will be noted, of course, that to move the arm 36 from the slot 38 to the slot 44 required that the tool 72 drive in response to a downward movement of its handle. To reach the condition illustrated in FIG. 2, it would thus have been necessary that the tool 72 drive in response to a downward movement of its handle. The direction in which the tool 72 drives or slips is determined by the setting of the selection control 76 appearing in FIG. 2. Thus, with the same wrench device 72, the operator can urge the arm 36 to move from the slot 38 to the slot 44 thus to increase the bias seeking to lift the trunk deck, or, alternatively, the operator can by reversing the control 76, decrease the spring tension by moving the arm 36 from the original slot 38 to the slot 46.

To assist in such movements, the operator may with a different tool, not shown, in his right hand bias the arm 36 outwardly from the housing 20 so that the arm 36 can be moved over the intermediate portions 42 which separate adjacent slots.

A difficulty frequently encountered in automobile repair, particularly in the trunk area, is that there is not sufficient room available in which to swing a socket wrench of the type illustrated through a sufficient angle to accomplish the desired work. Thus, the operator may have room only to move the arm 36 half the distance required to shift the arm 36 from the slot 38 to the slot 44. To allow the work to continue in this type of circumstance, the operator uses his right hand to engage the hexagonally shaped shank with an open-jaw type wrench 74, thus to hold the tool 50 at an intermediate position as the operator with his left hand ratchets the wrench 72 to a new position which will enable him to again lift the wrench 72 toward a position where the arm 36 can enter the slot 44 as the operator removes the open-jaw wrench 74 from its engagement with the clevis shank 52. Thus, the operator uses one hand, his left hand for example, to incrementally advance the arm 36 to a new position and uses the other hand, the right hand for example, to intermittently hold the clevis shank 52 at intermediate positions.

So far in the present description, the torsion spring adjustment has been confined to an adjustment of the arm 36 which is to the left side of the trunk opening. A similar adjustment may be required for the symmetrically opposite arm associated with the spring 32 and located to the right side of the trunk opening. Such adjustment would ordinarily require the operator to use his right hand to reposition the symmetrically opposite arm while using his left hand to periodically hold an intermediate position with an open-jaw wrench.

Since a tool such as the tool 50 may be driven from the operator's left or right side to change torsional bias, it is found highly desirable to the construction of the tool 50 that the confronting faces of the clevis plates 54 and 56 are milled symmetrically oppositely thus to allow the tool illustrated to operate in a plurality of modes.

For the same reasons, it is desirable that each of the clevis plates 54 and 56 has symmetrically oppositely arranged arcuate cutouts such as 62 and 64 so that as torsion is being applied to an arm such as the arm 36, the arcuate cutouts where delivering pressure to the arm being moved to a new position tend to cradle the arm being moved so that it will not inadvertently slip off the tool 50.

Although the preferred embodiment of the present invention has been described, it will be understood that various changes may be made within the scope of the appended claims.

Having thus described my invention, I claim:

1. A torsion spring adjustment tool comprising, in combination, a shank portion having a longitudinal axis and a surface made flat for wrench engagement, said shank portion supporting at one end thereof confronting plate portions fixed to and straddling said shank portion and spaced apart to receive therebetween a portion of said torsion spring so that when said shank portion is rotated about its longitudinal axis said confronting plate portions will drivingly engage and twist said torsion spring, said plate portions being rectangular with longest sides extending parallel to and lengthwise in the direction of said longitudinal axis, said plate portions having cut-outs in the side edges thereof extending along said longest sides, said cut-outs being spaced longitudinally outwardly from said shank, the confronting faces of said plate portions defining therebetween a first cylindrical passageway the axis of which is oblique to said confronting faces.

2. The tool of claim 1 wherein the axis of said passageway is aligned with said cut-outs.

3. The tool of claim 1 wherein said confronting faces of said plates define therebetween a second cylindrical passageway the axis of which is oblique to said confronting faces and inclined at a substantial angle to said first cylindrical passageway.

4. The tool of claim 3 wherein the axes of said first and second cylindrical passageways intersect.

5. The tool of claim 1 wherein said shank portion is hexagonal in cross section and said surface made flat for wrench engagement is one of the surfaces producing said hexagonal cross section.

6. The tool of claim 1 wherein said plate portions are welded to said shank portion.

7. The method of producing a torsion spring adjustment tool which comprises straddling one end of a shank portion by means of confronting plates forming a first cylindrical passageway extending between and oblique to the original faces of such plates, and forming a second cylindrical passageway extending between and oblique to the original faces of such plates inclined at a substantial angle to the first cylindrical passageway.

* * * * *